United States Patent [19]

Long et al.

[11] Patent Number: 4,486,064

[45] Date of Patent: Dec. 4, 1984

[54] POWER INTERFACE CONNECTOR

[75] Inventors: William B. Long, Camp Hill; Suel G. Shannon, Harrisburg; John R. Shuey, Carlisle; Daniel E. Stahl, Hummelstown, all of Pa.

[73] Assignee: AMP Incorporated, Harrisburg, Pa.

[21] Appl. No.: 447,910

[22] Filed: Dec. 8, 1982

[51] Int. Cl.[3] ..... H01R 13/39

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,824,530 | 7/1974 | Roberts et al. | 339/99 R |
| 3,860,318 | 1/1975 | Reavis, Jr. et al. | 339/99 R |
| 4,148,540 | 4/1979 | Hayes | 339/99 R |
| 4,306,759 | 12/1981 | Norden | 339/99 R |
| 4,317,608 | 3/1982 | Dechelette | 339/99 R |
| 4,410,229 | 10/1983 | Stephenson | 339/99 R |

*Primary Examiner*—Joseph H. McGlynn
*Attorney, Agent, or Firm*—Adrian J. LaRue

[57] ABSTRACT

An electrical connector for connecting insulated conductors to electrical terminals comprises a dielectric housing member having terminal-receiving passageways extending therethrough and conductor-receiving areas extending normal to the terminal-receiving passageways. Electrical terminals are secured in the terminal-receiving passageways; each of the terminals includes a contact section and a conductor-terminating section. The conductor-terminating section is formed of overlapping members having coincident slots, the outer angled edges of the slots adapted to cut through the insulation of the conductor when the conductor is forced into the slots and inner parallel edges of the slots adapted to score and electrically engage the conductive core of the conductor. A cover member has opposing leg members that extend along the overlapping members of the conductor-terminating sections as the leg members move into respective terminal-receiving passageways, the leg members having arcuate surfaces that will force the conductive cores of the conductors to the rounded bottoms of the coincident slots when the cover member is positioned on the housing member. The housing member and the cover member have latching members latching them together and the overlapping members of the conductor-terminating sections include securing barbs that engage the leg members thereby securing the cover member in position on the housing member and maintaining the conductive cores adjacent the rounded bottoms of the coincident slots.

20 Claims, 12 Drawing Figures

POWER INTERFACE CONNECTOR

FIELD OF THE INVENTION

This invention relates to electrical connectors and more particularly to electrical connectors for supplying electrical power to printed circuit boards.

BACKGROUND OF THE INVENTION

More and more components are being added to printed circuit boards. This being the case, low and high voltages both at high current are needed to operate the components. The termination resistance must be low to make certain the voltage stays within specified limits to operate the electronic circuits.

A common practice to connect current-carrying conductors to printed circuit boards is to terminate the conductors to electrical terminals which are connected to power circuits on the board by screws or bolts. These connections have proven satisfactory; however, they have drawbacks. The applied cost is high as a result of first terminating the conductors to the electrical terminals and then connecting the terminals to the power circuits on the board. The termination resistance can be affected if the screws or bolts work loose as they are wont to do. Servicing can be a problem for the reason that the connections have to be unscrewed and rescrewed. Connecting the power conductors to more than one board is difficult.

SUMMARY OF THE INVENTION

According to the present invention, an electrical conductor for connecting insulated conductors to electrical terminals comprises a dielectric housing member having terminal-receiving passageways extending therethrough and conductor-receiving areas extending normal to the terminal-receiving passageways. Electrical terminals are secured in the terminal-receiving passageways; each of the terminals includes a contact section and a conductor-terminating section. The conductor-terminating section is formed of overlapping members having coincident slots, the outer angled edges of the slots adapted to cut through the insulation of the conductor when the conductor is forced into the slots and inner parallel edges of the slots adapted to score and electrically engage the conductive core of the conductor. A cover member has opposing leg members that extend along the overlapping members of the conductor-terminating sections as the leg members move into respective terminal-receiving passageways, the leg members having arcuate surfaces that will force the conductive cores of the conductors to the rounded bottoms of the coincident slots when the cover member is positioned on the housing member. The housing member and the cover member have latching members latching them together and the overlapping members of the conductor-terminating sections include securing barbs that engage the leg members thereby securing the cover member in position on the housing member and maintaining the conductive cores adjacent the rounded bottoms of the coincident slots.

According to another embodiment of the present invention, the conductor-receiving areas of the housing member and the latching members of the cover member form strain reliefs for the conductors.

According to a further embodiment of the present invention, a front end of the housing member is matable with a like front end of another housing member with the contact sections of the electrical terminals in the matable housing members electrically connected together.

According to an additional embodiment of the present invention, keying members are mounted in each of the front ends of the matable housing members for keying the housing members to each other.

DETAILED DESCRIPTION OF THE INVENTION

Figure 1:
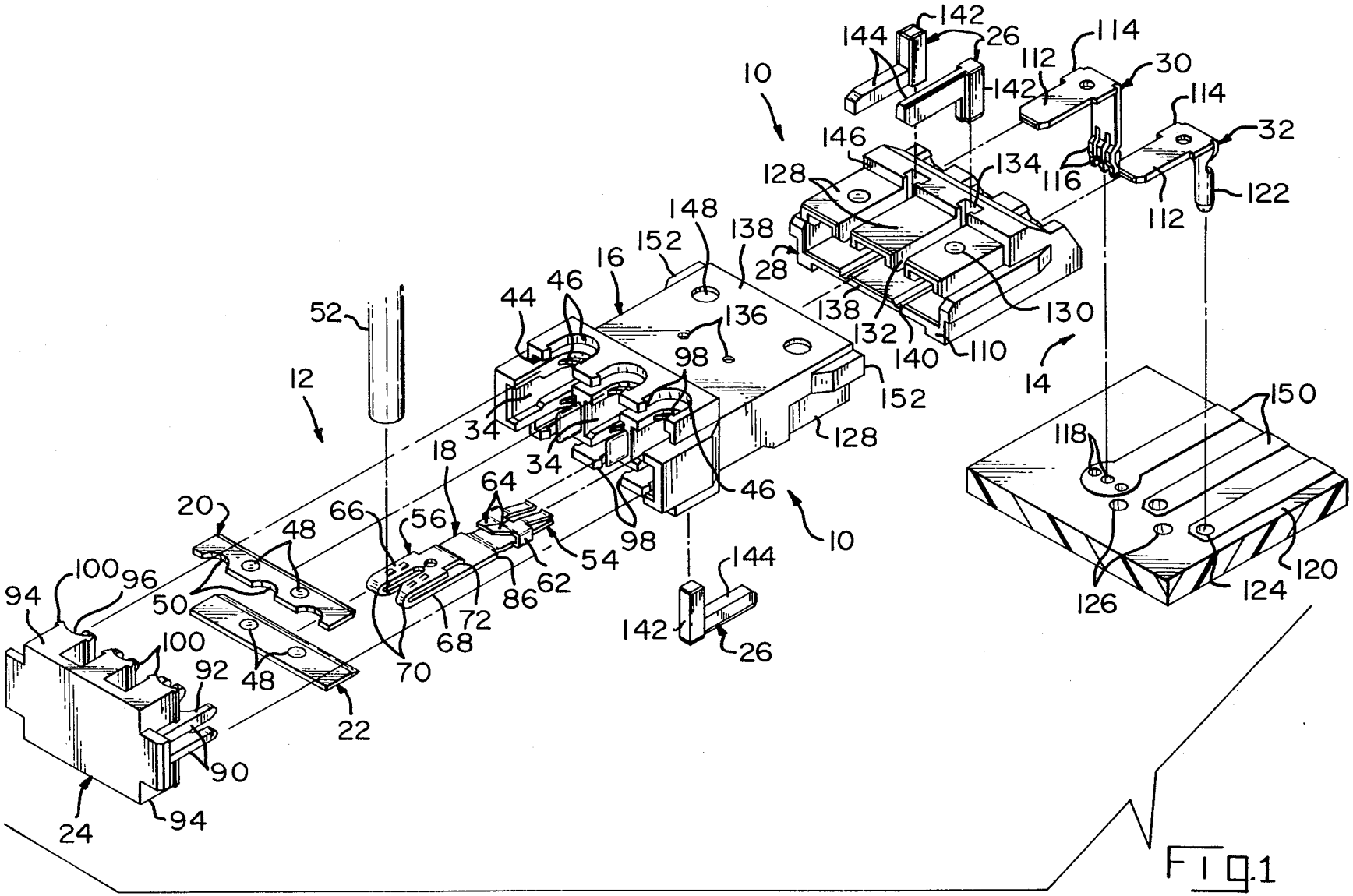
FIG. 1 is an exploded and perspective view of the parts of a matable electrical connector assembly.
Figure 2:
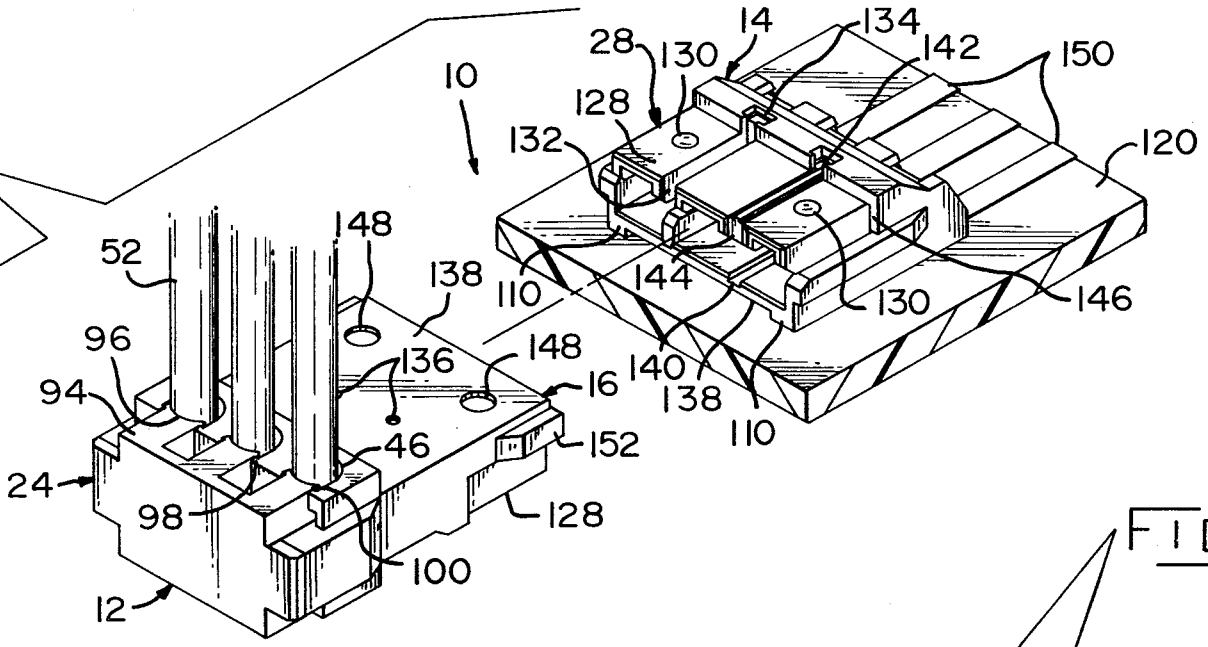
FIG. 2 is an exploded and perspective view of the matable connectors in an assembled condition.

As shown in FIGS. 1 and 2, a power interface connector 10 comprises a power conductor connector 12 and a printed circuit board connector 14. Power conductor connector 12 includes a dielectric housing member 16, electrical terminals 18, strain relief member 20, gate 22, cover member 24, and polarizing key 26. Printed circuit board connector 14 includes dielectric housing member 28, electrical terminals 30, 32, and polarizing keys 26. Housing member 16, strain relief member 20, gate 22, cover member 24, polarizing keys 26, and housing member 28 are molded from a suitable thermoplastic material and terminals 18, 30, and 32 are stamped and formed from a suitable metal and are preferably plated.

Figure 3:
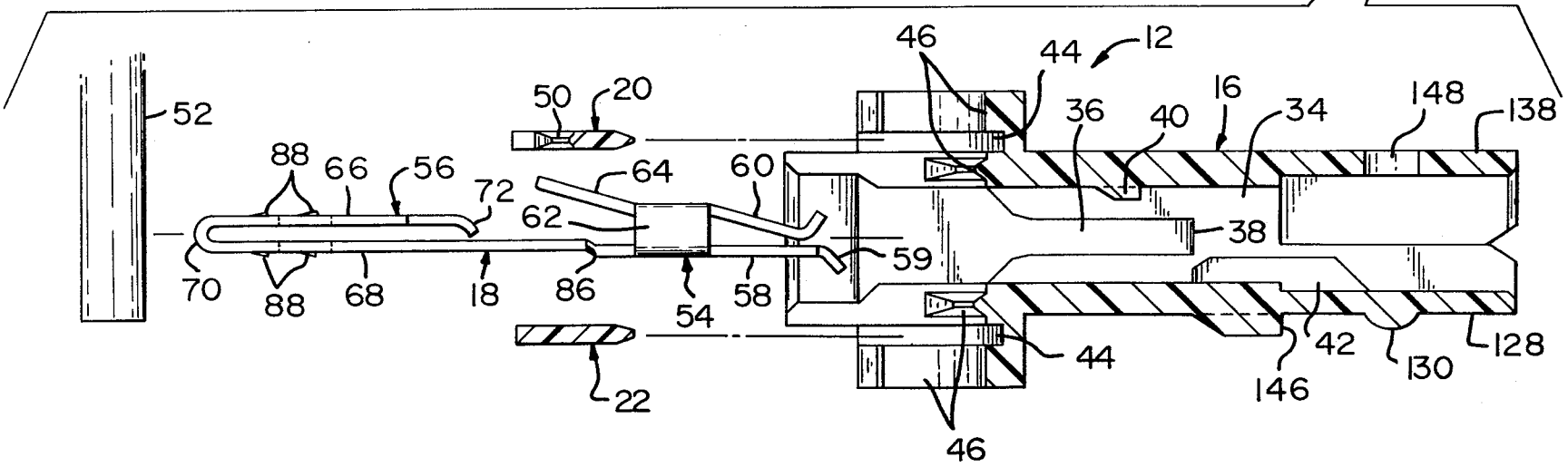
FIGS. 3 through 5 are cross-sectional views of the assembly of the electrical connector terminating the power conductors.

Housing member 16 has profiled passageways 34 extending therethrough, the sidewalls of each passageway having opposing recesses 36. The inner ends of recesses 36 as shown in FIG. 3 define stop surfaces 38. Projections 40 extend outwardly from the upper surfaces of passageways 34 and projections 42 extend outwardly from the bottom surfaces, projections 40 and 42 being disposed rearwardly and forwardly of stop surfaces 38. Channels 44 extend across housing member 16 which are in communication with conductor-receiving recesses 46 of U-shaped configuration. Conductor-receiving recesses 46 extend at right angles with respect to respective passageways 34.

Figure 12:
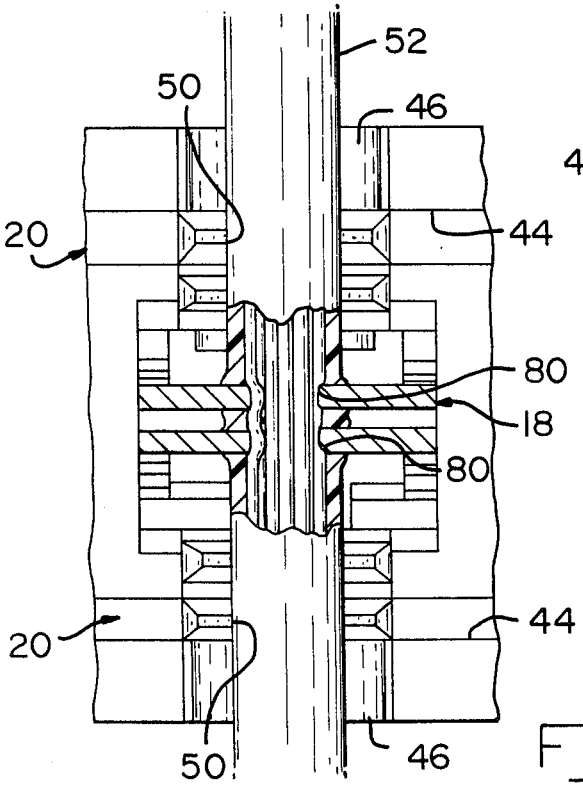
FIG. 12 is a view similar to FIG. 11 showing an alternative embodiment of the strain members.

Strain relief members 20 are disposed in channels 44 and are frictionally maintained therein via part-spherical bumps 48 and each has U-shaped recesses 50 in communication with respective recesses 46 so that insulated conductors 52 can be disposed in recesses 46, 50 as feed-through conductors with strain relief being provided by strain relief members 20 as shown in FIG. 12. The recesses 50 in strain relief members 20 will be of the appropriate size to accommodate conductors 52. Thus, depending on the size of conductors to be terminated will determine which strain relief members will be disposed in channels 44.

Figure 11:
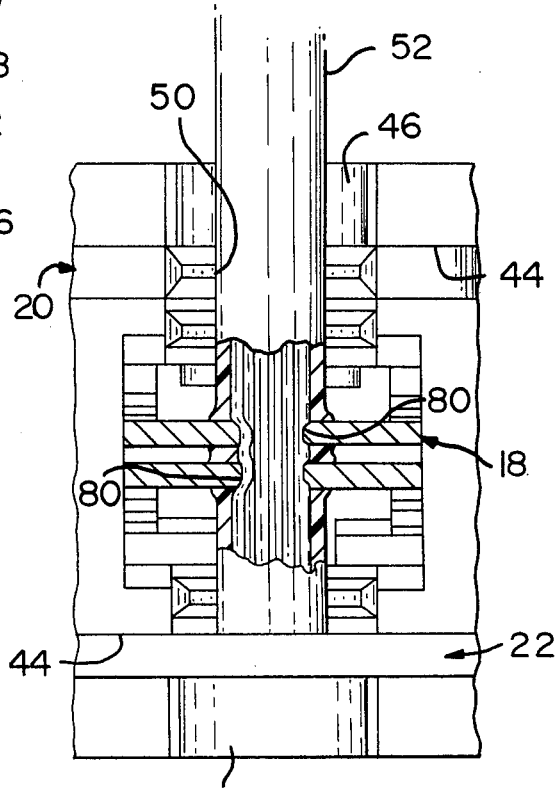
FIG. 11 is a view taken along line 11—11 of FIG. 5.

If desired, gate 22 having part-spherical bumps 48 thereon can be disposed in one of channels 44 and acts as an end-of-line connector as shown in FIG. 11. Strain relief members 20 and gate 22 can be formed as integral members when the housing member is molded.

Electrical terminals 18 have a contact section 54 and a conductor-terminating section 56. Contact section 54 has a planar member 58 and spring members 60 with curved ends are angled toward the front end of planar member 58. Spring members 60 are joined to planar member 58 by side members 62 from which depend latch members 64. Planar member 58 has a centrally disposed curved extension 59. The curved ends of spring members 60 and curved extension 59 serve as a lead-in to contact section 54.

Conductor-terminating section 56 comprises overlapping members 66, 68 joined together by bights 70 and spaced from one another by bights 70 and curved end 72. Members 66, 68 have coincident conductor-terminating slots therein which include inclined lead-in surfaces 74, parallel surfaces 76 which end in radiussed surfaces as a U-shaped configuration. Inclined surfaces 74 are at about a 30° angle relative to the vertical axis of the terminating slots. Chamfers 78, 80 are located along the outer edges of surfaces 74, 76 respectively and the sections between surfaces 74 and 76 are radiussed to provide a smooth transition therebetween. Holes 82 are located below the conductor-terminating slots and are joined therewith by a shear 84. Surfaces 86 are located at the transition between contact section 54 and conductor-terminating section 56. Barbs 88 are stamped outwardly from members 66, 68 and extend in a direction toward contact section 54.

Figure 4:
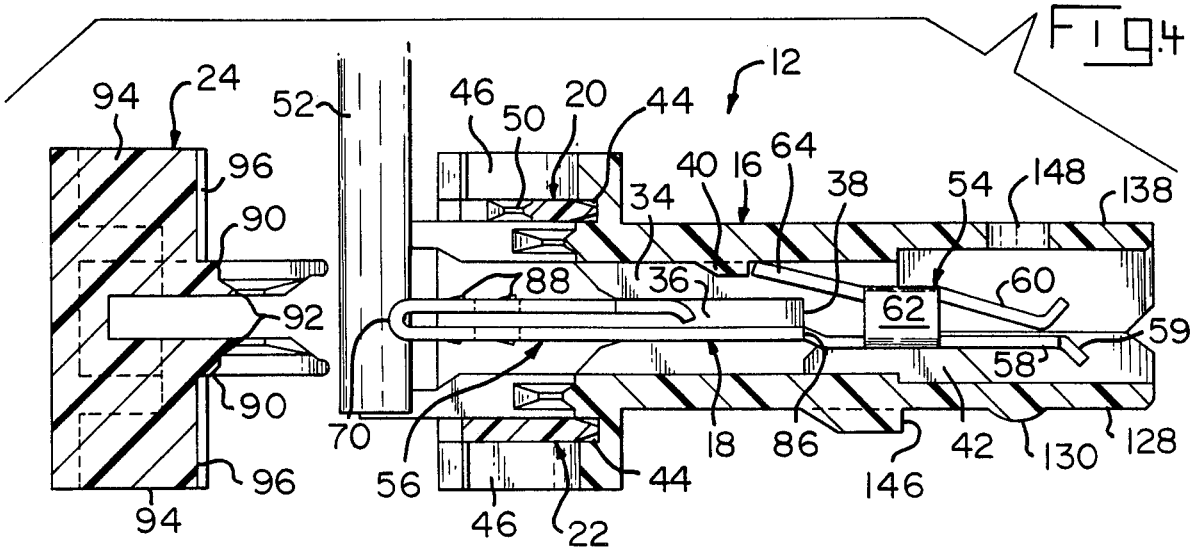
Figure 5:
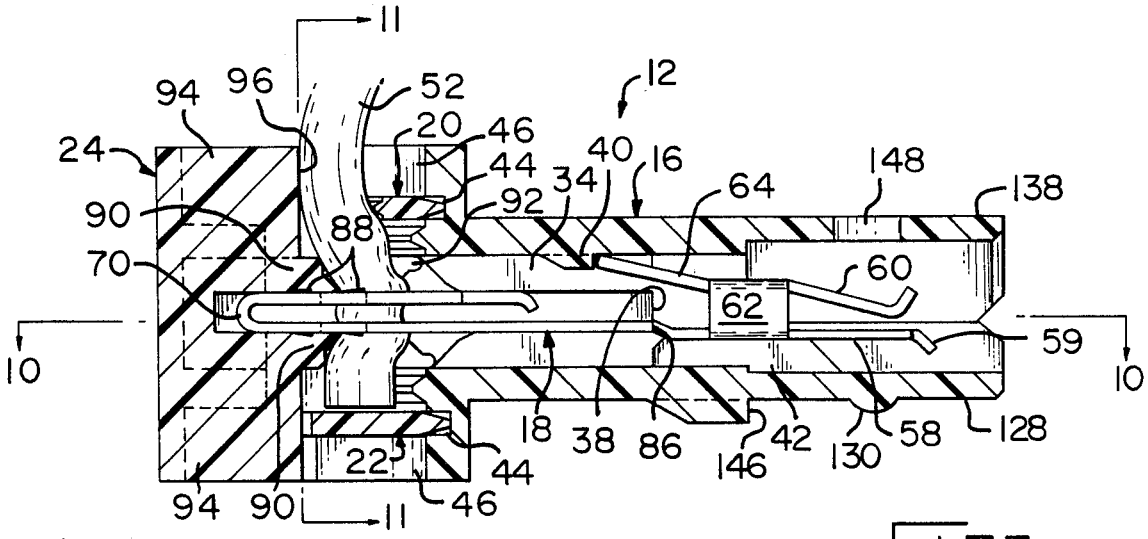
Figure 6:
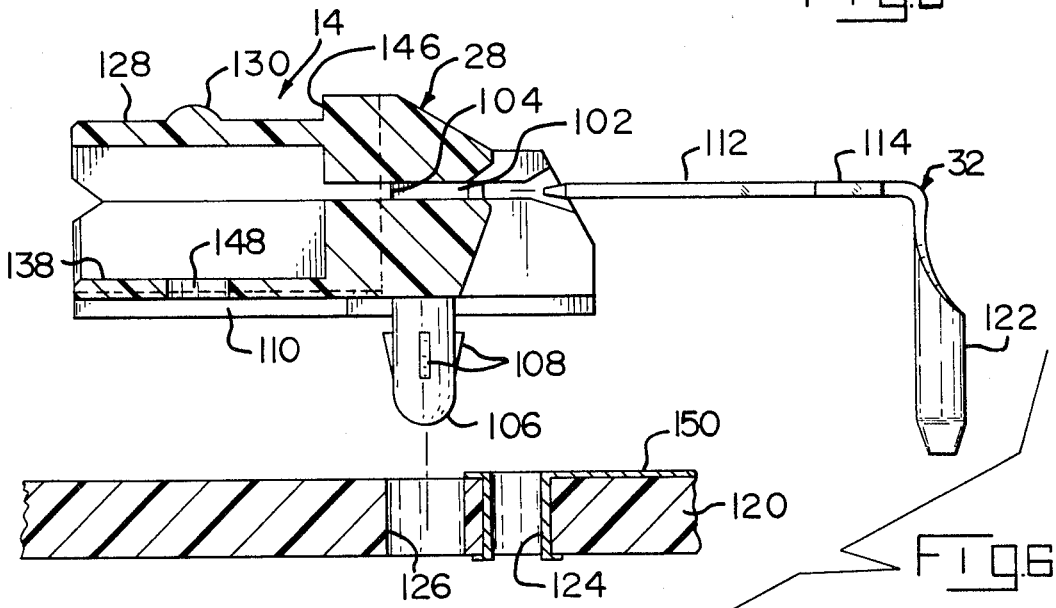
FIGS. 6 and 7 are cross-sectional views of the assembly of the electrical connector onto a printed circuit board.
Figure 7:
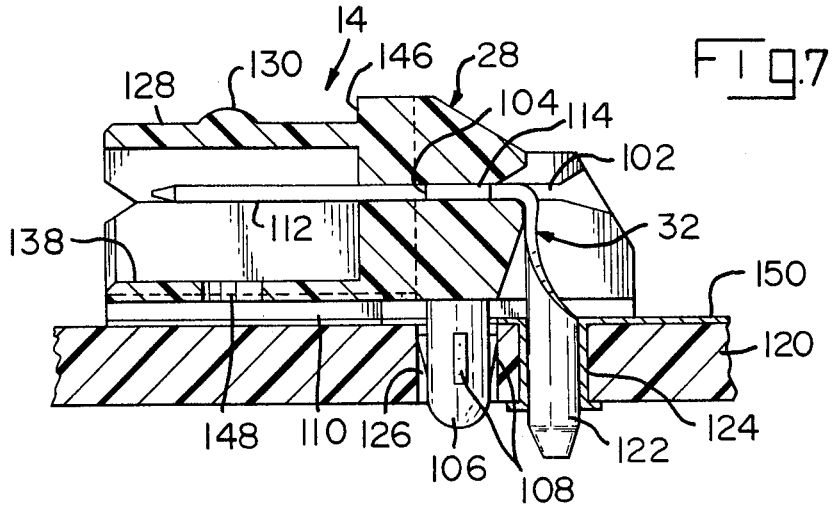

Electrical terminals 18 are positioned in passageways 34 with surfaces 86 engaging stop surfaces 38 in recesses 36 to limit forward movement of electrical terminals 18 therein and latch members 64 are positioned in front of projections 40 thereby latchably securing electrical terminals 18 in position in respective passageways 34 as illustrated in FIG. 4. Planar members 58 of contact sections 54 are positioned on projections 42, latch members 64 springably maintaining planar members 58 is engagement with projections 42 and centering contact sections 54 within the passageways. The forward edges of members 66, 68 are disposed in recesses 36 and the inner radiussed ends of the conductor-terminating slots are in alignment with recesses 46.

Figure 10:
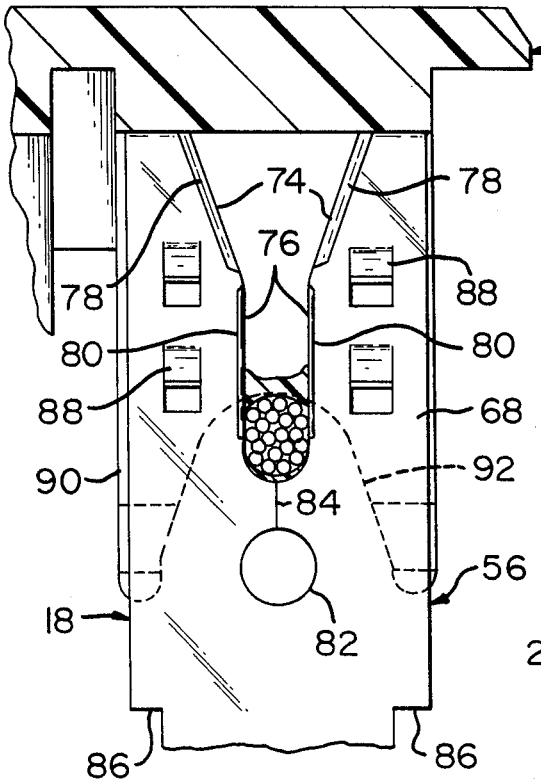
FIG. 10 is a view taken along line 10—10 of FIG. 5.

With terminals 18 secured in position in passageways 34 of housing member 16, insulated conductors 52 can now be terminated to electrical terminals 18. The cores of insulated conductors 52 can be solid wire conductors or stranded conductors. Conductors 52 are placed in engagement with inclined lead-in surfaces 74 of the redundant conductor-terminating slots as shown in FIG. 4. Cover member 24 is then brought into engagement with conductors 52 to force the conductors into the terminating slots to terminate them therein and to secure them in position therein. Cover member 24 has pairs of spaced legs 90 that extend into passageways 34 along members 66, 68. Legs 90 have U-shaped recesses 92 therein to engage conductors 52 and force them along inclined lead-in surfaces 74 to cut through the insulation and along parallel surfaces 76 which score the cores thereof and make electrical connection therewith as shown in FIG. 10. The strands of the conductors are forced to the radiussed bottoms of the slots by recesses 92 and they are maintained in this position due to barbs 88 digging into the inside surfaces of legs 90 thereby securing cover member 24 in position on housing member 16.

Extending outwardly from legs 90 are conductor-engaging members 94 which have arcuate surfaces 96 which engage conductors 52 forcing them into recesses 46 of housing member 16 and into recesses 50 of strain relief members 20. This provides strain relief for the conductors 52. Lugs 98 of recesses 46 mate with lugs 100 of conductor-engaging members 94 to latch cover member 24 to housing member 16.

As shown in FIG. 10, the strands of the conductors are bunched together within the redundant terminating slots and are held in such condition by recesses 92 of legs 90 when cover 24 is latchably secured in position on housing member 16. Shears 84 separate the terminating slots from holes 82 and this enables holes 82 to distribute the high stresses caused by the terminating forces generated by the compacting of the strands of the conductors within the terminating slots thereby resulting in an excellent mechanical and electrical termination.

As shown in FIGS. 11 and 12, chamfers 80 along the outer edges of parallel surfaces 76 form a bell-mouth transition at both ends of the termination for improved vibration resistance and better overall crimp. These chamfers also serve the following purposes: they eliminate the possibility of severing strands by the dragging action of the strands over the relatively long length of the parallel surfaces; they eliminate the high stress concentrations which can cause fracture of the wires during vibration; they provide for smoother wire deformation during the sliding action of the wire strands into the slots; they provide a larger area of contact.

Housing member 28 of printed circuit board connector 14 as shown in FIGS. 1, 2, 6 and 7 has profiled passageways 102 extending therethrough which have stop surfaces 104 therein. Mounting members 106 having rounded ends extend outwardly from the bottom surface of housing member 28. Wedge-shaped projections 108 extend outwardly from mounting members 106 therearound. Feet 110 extend along the sides of housing member 28.

Electrical terminals 30, 32 have contact sections 112 which include projections 114 that engage stop surfaces 104 in passageways 102 when contact sections 102 are frictionally fitted therein. Terminal 30 has compliant pins 116 that electrically connect with plated-through holes 118 in printed circuit board 120, whereas terminal 32 has a pin contact section 122 that is electrically connected with through holes 124 in printed circuit board 120.

Figure 8:
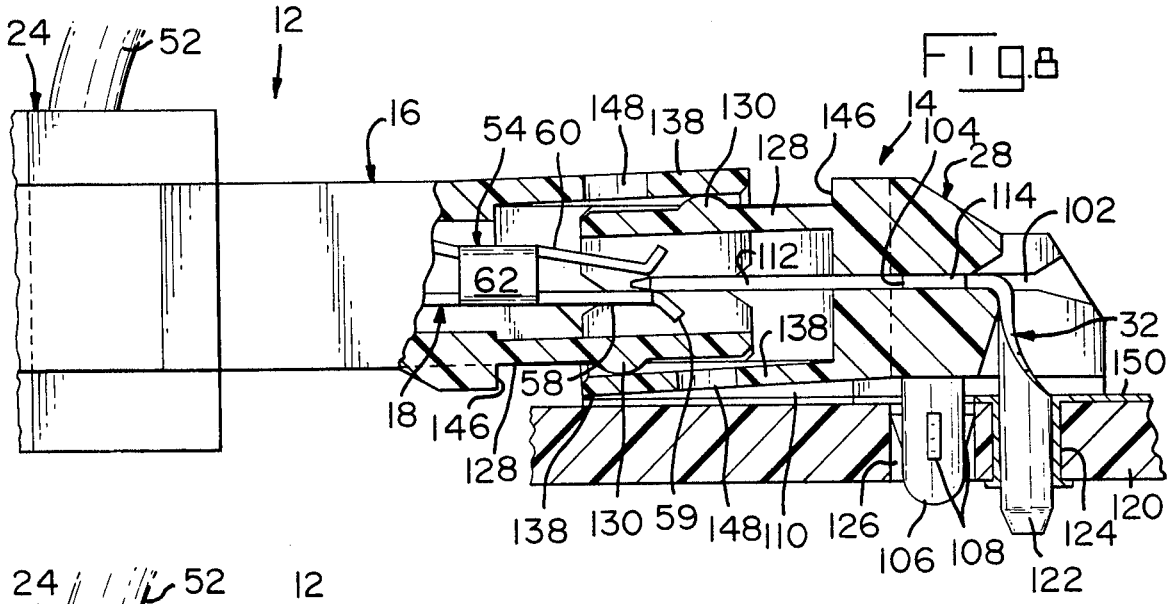
FIGS. 8 and 9 are part cross-sectional views showing the mating of the matable parts of the connectors.

After electrical terminals 30 or 32 have been positioned in passageways 102 of housing member 28, housing member 28 can then be positioned on printed circuit board 120 with mounting members 106 frictionally disposed in holes 126 via wedge-shaped projections 108 and compliant pins 116 are electrically connected within plated-through holes 118 if terminals 30 are used or pin contact sections 122 are electrically connected with through holes 124 if terminals 32 are used. Thereafter pins 116 or pin contact sections 122 can be soldered to through holes 118 or 124. Feet 110 position connector 14 from board 120 for ventilation purposes and to enable the bottom section of the front end of the housing member to move when being mated with another connector as shown in FIG. 8. Connector 14 is now in position to be electrically connected with connector 12.

The front ends of housing members 16 and 28 have the same configuration thereby enabling the front ends of the housing members to be intermatable because they are hermaphroditic. The front end of housing member 28 will therefore be described which also covers the front end of housing member 16. As shown in FIGS. 1 and 2, the front end of housing member 28 has U-shaped sections extending outwardly from the main body of housing member 28 as separate sections. Outer sections 128 have part-spherical bumps 130 centrally disposed thereon. Sections 128 cover respective tab contact sections 112. A space 132 is located between sections 128 and they extend into the main part of housing 28 in the form of vertical recesses 134 which communicate with small holes 136 that are located in a U-shaped skirt 138 disposed opposite sections 128. Channels 140 are disposed on the inside surface of skirt 138 in alignment with spaces 132.

Polarizing keys 26 have an L-shaped configuration with legs 142 being disposable within vertical recesses 134 while legs 144 are disposable within spaces 132 or channels 140, depending on which direction polarizing keys are positioned within recesses 134 and spaces 132. To remove polarizing keys 26 from housing member 16 or housing member 28, a pin is inserted in small holes 136 to engage legs 142 to push the polarizing keys 26 outwardly so they can be removed.

To make certain that connector 12 is to be connected with a certain connector 14, polarizing keys 26 are inserted into housing member 16 and 28 in the same spaces 132 and/or channels 140 of each of the housing members to make certain that the housing members can only be matable with one another.

Figure 9:
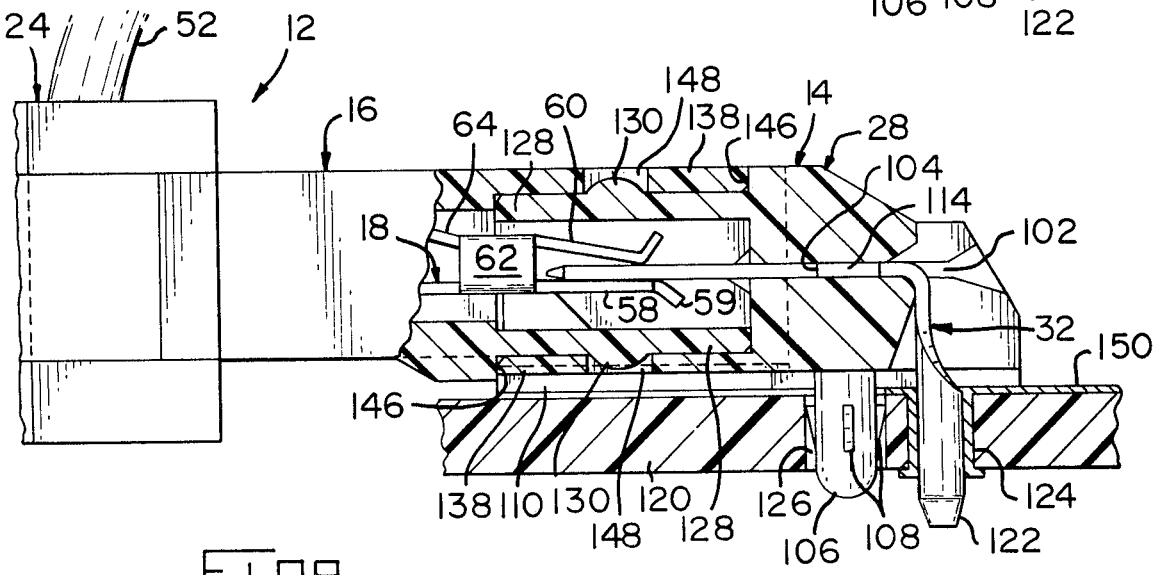

When power conductor connector 12 is to be mated with printed circuit board connector 14 with polarizing keys 26 properly positioned in the housing members thereof, skirts 138 of the housing members move along sections 128 so that sections 128 are disposed within skirts 138 until the front ends of the housing members engage stop surfaces 146 with bumps 130 being disposed in holes 148 in skirts 138 as shown in FIGS. 8 and 9. Thus with the hermphroditic sections of housing members 16 and 28 in engagement with each other, contact sections 54 of electrical terminals 18 and contact sections 112 of electrical terminals 30 or 32 are electrically connected with each other to supply electrical power from conductors 52 to busses 150 on board 120. If desired, the front ends of power conductor connectors 12 can be interconnected because the contact sections 54 of electrical terminals 18 are intermatable thereby interconnecting insulated conductors 52 in each of power conductor connectors 12. Printed circuit board connectors 14 can be interconnected with one another to interconnect busses 150 in a mother/daughter board relationship. In order to do this, one of the printed circuit board connectors 14 must have a contact section like contact section 54 of electrical terminals 18 in place of the tab contact sections 112. Of course, both electrical terminals 30 or 32 in each of the printed circuit board connectors 14 can have contact sections 112 in the form of contact sections 54 if desired.

Projections 152 are located on each side at the front end of housing member 16 to make certain that connectors cannot be partly mated, i.e., one or two contact sections of connectors electrically connecting together.

Each of conductors 52 can have the same voltage thereon and current passing therethrough or a different voltage and current can be present in each conductor. The keying arrangement between matable connectors assures that connectors are correctly connected together.

We claim:

1. An electrical connector of the type for electrically connecting insulated electrical conductors to electrical terminals secured in passageways of a dielectric housing member, the electrical terminals having contact sections disposed in a front section of the housing member and conductor-terminating sections disposed in the passageways, the conductor-terminating sections having terminating slots in alignment with conductor-receiving recesses in the housing member, the conductor-receiving recesses extending normal to the passageways for receiving the electrical conductors therein where the conductive cores of the conductors are terminated in the terminating slots, a cover member having pairs of opposed legs that extend into respective passageways along the conductor-terminating sections for forcing the conductors into the terminating slots, the cover member and the housing member having matable latching members latching the cover member to the housing member, characterized in that:

said conductor-terminating sections each having closely-spaced overlapping members, the overlapping members having said terminating slots therein in coincident alignment, each of the terminating slots having upper inclined surfaces for shearing through the insulation of the conductors and parallel surfaces for scoring and electrically terminating the conductive cores of the conductors when the conductors are forced into the terminating slots by the opposed legs, barbs on the conductor-terminating sections engaging the opposed legs thereby securing the cover member onto the housing member so that the conductive cores of the conductors are maintained terminated in the terminating slots.

2. An electrical connector as set forth in claim 1, characterized in that a curved end of one of the overlapping members and bights connecting the overlapping members together maintain the overlapping members spaced from one another.

3. An electrical connector as set forth in claim 1, characterized in that the outer edges of the inclined surfaces and the parallel surfaces are chamfered, the parallel surfaces extending into radiussed surfaces, a hole spaced from the radiussed surfaces and a shear connecting the radiussed surfaces to the hole.

4. An electrical connector as set forth in claim 1, characterized in that said conductor-receiving recesses include U-shaped recesses in cooperation with arcuate surfaces of said latching members of said cover member for engaging the conductors to define a strain relief arrangement for the conductors.

5. An electrical connector as set forth in claim 4, characterized in that said U-shaped recesses are located in strain relief members disposed in channels in said housing member.

6. An electrical connector as set forth in claim 5, characterized in that a gate is disposed in one of said channels against which ends of the conductors are to be disposed.

7. An electrical connector as set forth in claim 1, characterized in that the front end of the housing member has a connector-matable section including U-shaped sections having spaces therebetween, said U-shaped sections being disposed within a U-shaped skirt spaced from said U-shaped sections, said contact sections being disposed within respective U-shaped sections medially between said U-shaped sections and said Ushaped skirt, said connector-matable section adapted to be matable with a like connector-matable section of another electrical connector.

8. An electrical connector as set forth in claim 7, characterized in that polarizing keys can be secured in said spaces to assure matable engagement between matable connectors.

9. An electrical connector as set forth in claim 8, characterized in that projections extend outwardly from sides of the front end of one of the matable connectors to prevent mismatching of connectors.

10. An electrical connector for connecting insulated conductors to electrical terminals, comprising:

dielectric housing means having terminal-receiving passageways and conductor-receiving areas extending normal to each other;

electrical terminal means secured in said terminal-receiving passageways, said terminal means having contact means extending along a front section of said housing means and conductor-terminating means disposed in a back section of said housing means, said conductor-terminating means having closely spaced overlapping member means along which coincident terminating slot means extend, said terminating slot means being in alignment with said conductor-receiving areas and having inclined surfaces at entrances thereto and parallel surfaces ending in radiussed surfaces;

cover means having pairs of leg means for extending along respective overlapping member means and surface means for engaging the conductors when disposed against said inclined surfaces, said surface means adapted to force the conductors along the inclined surfaces to cut through the insulation of the conductors and along the parallel surfaces to score and terminate the conductive cores adjacent the radiussed surfaces when said cover means is pushed into position on said housing means;

latching means on said housing means and said cover means for latching said cover means and said housing means together; and securing means on said conductor-terminating means for engaging said leg means and securing said cover means on said housing means so that said surface means maintains the conductive cores in a terminated position in said terminating slot means.

11. An electrical connector as set forth in claim 10 wherein a curved end of one of said overlapping member means and bight means connecting said overlapping member means together maintain the overlapping member means spaced from each other.

12. An electrical connector as set forth in claim 10 wherein said securing means comprise barbs extending outwardly from said overlapping member means in the direction of said contact means for digging into inside surfaces of said leg means.

13. An electrical connector as set forth in claim 10 wherein said conductor-receiving areas have U-shaped recesses in which the conductors can be disposed and said latching means on said cover means have arcuate surface means for maintaining the conductors against said U-shaped recesses thereby defining strain relief means for the conductors.

14. An electrical connector as set forth in claim 13 wherein the U-shaped recesses are located in strain relief members disposed in channels in said housing means.

15. An electrical connector as set forth in claim 14 wherein gate means is disposed in one of the channels against which ends of the conductors are to be disposed.

16. An electrical connector as set forth in claim 10 wherein outer edges of the inclined surfaces and the parallel surfaces are chamfered.

17. An electrical connector as set forth in claim 16 wherein holes are spaced from the radiussed surfaces and shears connect the radiussed surfaces with the holes.

18. An electrical connector as set forth in claim 10 wherein the front end of the housing means has a matable connector section which is matable with a like connector-matable section of another electrical connector.

19. An electrical connector as set forth in claim 18 wherein polarizing key means are secured in said matable connector sections to assure matable engagement between the matable connectors.

20. An electrical connector as set forth in claim 18 wherein projections extend outwardly from sides of the front end of one of the matable connectors to prevent mismatching of connectors.

* * * * *